US005186036A

United States Patent [19]

Kamada

[11] Patent Number: 5,186,036

[45] Date of Patent: Feb. 16, 1993

[54] CABLE WIRE BENDING METHOD AND CABLE WIRE BENDING DEVICE

[75] Inventor: Satoshi Kamada, Tsu, Japan

[73] Assignee: Sumitomo Wiring Systems, Ltd., Yokkaichi, Japan

[21] Appl. No.: 789,609

[22] Filed: Nov. 8, 1991

[30] Foreign Application Priority Data

Nov. 13, 1990 [JP] Japan ..... 2-308242

[51] Int. Cl.[5] ..... H01R 43/28

[52] U.S. Cl. ..... 72/306; 72/403; 72/342.92; 29/861; 29/867

[58] Field of Search ..... 72/306, 403, 342.92, 72/342.7, 342.96, 342.94, 342.1; 29/867, 861

[56] References Cited

U.S. PATENT DOCUMENTS 2,472,778 6/1949 Quinn ..... 72/342.1
2,473,919 6/1949 Stone ..... 72/403
3,668,764 6/1972 Randar ..... 29/867

FOREIGN PATENT DOCUMENTS 216303 7/1961 Austria ..... 72/342.1
280930 11/1990 Japan ..... 72/342.1

*Primary Examiner*—Daniel C. Crane
*Attorney, Agent, or Firm*—Sughrue, Mion, Zinn, Macpeak & Seas

[57] ABSTRACT

An electric cable bending device for bending an exposed portion of core wire of electric cable having a coating member mounted on a non exposed portion of said core wire has a clamping unit, a vertical hot press, a horizontal hot press, and a vertically supporting unit. The clamping unit clamps the electric cable such that the exposed portion of core wire is located at a position under the vertical hot press and between the supporting unit and the horizontal hot press. By the down stroke of the vertical hot press, the exposed core is heated and bent perpendicularly. The supporting unit supports the cable against a pushing force generated during the stroke of the horizontal hot press, while the perpendicularly bent exposed core is heated and bent back toward another end of the electric cable. As a result, thus bent core wire is firmly and tightly bent in a U-shape for ensuring the complete electrical contact with the terminal lug which will be provided in the following process.

4 Claims, 4 Drawing Sheets

CABLE WIRE BENDING METHOD AND CABLE WIRE BENDING DEVICE

BACKGROUND OF THE INVENTION

1. Field of the Invention

The present invention relates to a method and device for bending an exposed core wire of an electric cable for effecting a firm and tight connection with a terminal lug.

2. Description of the Prior Art

U.S. Pat. No. 3,668,764 issued to Randar on Jun. 13, 1972 shows an example of the prior art method in which an exposed core wire of the electric cable is bent back along the cable surface, and then a terminal lug is applied around the end portion of the stripped end so that the exposed core wire is electrically held in contact with the terminal lug.

As shown in FIG. 2, a clamping unit 11 clamps the electric cable P which has an end portion which has been stripped of the coating member to expose a core wire A. The core wire A is brought under a punch 12.

As shown in FIG. 3, as the punch 12 goes down, the core wire A is bent downwardly. Then the punch 12 and an anvil 13 are moved substantially parallel to the axis of the cable P, and then a terminal lug B is moved and guided along a U-groove of the anvil 13.

While the terminal lug B is moved, the downwardly bent core wire A is further bent back by the terminal lug B in a U-shape, as shown in FIG. 4. Then, a crimper 14 goes down to crimp the terminal lug B to locate the bent back core wire A between the terminal lug B and the insulating member of the cable P, as shown in FIG. 5.

However, as shown in FIG. 6, according to the prior art as described above, the bent portion of the core wire A may returned by its resiliency, resulting in the wire bending at the mid-point of the stripped wire portion in response to the backward movement of the lug B. In this case, a firm electric contact between the terminal lug B and the core wire A can not be ensured.

Also, as shown in FIG. 7, when the core wire A hangs down due to its resiliency, the core wire A may be undesirably cut by the edge of terminal lug B.

The above of problems are often observed in a wrapped type of electric cable P, such as shown in FIG. 8. The wrapped type electric cable P is formed by a tension member 1 made of aramid fibers. A core 2 of thermoplastic material is mounted on tension member 1 and a resistant wire (conductor) 3 is spirally wound around the core 2. An insulator 4 and sheath 5 are further mounted on the core 2 and the resistant wire 3.

As a result of such construction, when the wrapped cable P is stripped of the insulator 4 and sheath 5 by a given length from the end for a bending operation as shown in FIG. 2, the core wire A is different to bend but easily returns to the straight state because the core wire A in this case is made of tension member 1, core 2 and resistant wire 3 having a high elasticity. Thus, the above described problems are often observed. It is to be noted that both of the insulator 4 and sheath 5 hereinafter will be referred to as the "insulating coating".

SUMMARY OF THE INVENTION

The object of the present invention is therefore to provide an electric cable bending method and an electric cable bending device which solves these problems.

The present invention has been developed with a view to substantially solving the above described disadvantages and has for its essential object to provide an improved electric cable bending method and an improved electric cable bending device.

In order to achieve the aforementioned objective, a bending method for bending an exposed core wire of an electric cable has the steps of clamping the electric cable at a clamping position close to the exposed core wire, vertically bending the exposed core wire, while applying heat thereto, at angle substantially perpendicularly to the axis of the electric cable, and horizontally bending the perpendicularly bent core wire, while applying heat thereto, at an angle substantially parallel to the axis of the electric cable along the surface of the insulating member.

BRIEF DESCRIPTION OF THE DRAWINGS

These and other objects and features of the present invention will become clear from the following description taken in conjunction with the preferred embodiment thereof with reference to the accompanying drawings throughout which like parts are designated by like reference numerals, and in which.

DETAILED DESCRIPTION OF THE PREFERRED EMBODIMENTS

Figure 1:
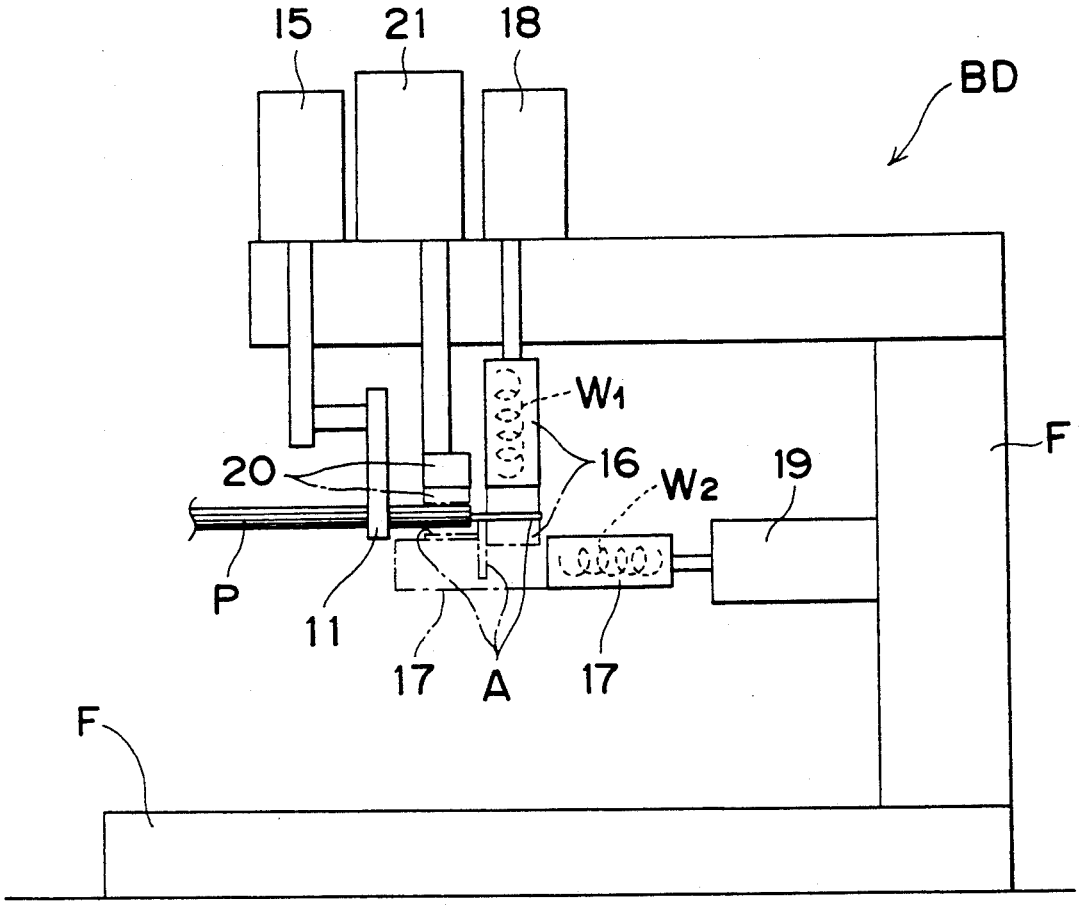
FIG. 1 is a schematic side view of an electric cable bending device according to a preferred embodiment of the invention.

Referring to FIG. 1, an electric cable bending device BD according to a preferred embodiment of the present invention is shown, in which an electric cable P is inserted. The bending device BD has a generally U-shaped frame F including a horizontal base, a vertical stand and a top beam parallel to the horizontal base. A clamp unit 11 is provided at the front end and on the lower surface of the top beam for clamping the cable P. A support unit 20 is provided behind the clamping unit 11 for supporting the cable P against a vertical force, and a vertical hot press 16 is provided behind the support unit 20 for bending down an exposed core wire A of the cable P. A horizontal hot press 17 is provided behind the vertical hot press 16 and on the inner surface of the vertical stand for bending back the core wire A in U-shape. Clamping unit 11, support unit 20, vertical hot press 16, and horizontal hot press 17 are coupled to and driven by a motor 15, a cylinder 21, a cylinder 18, and a cylinder 19, respectively.

The cable P whose end portion is stripped is inserted so that the exposed core wire A of the cable P relocated under the vertical hot press 16. The inserted position of the cable P is adjusted by the strokes of a cable inserting jig (not shown). The clamping unit 11 is driven by the motor 15 via an appropriate gear box so as to clamp and hold the cable P at a clamping position.

As shown in FIG. 1, when the cable P is brought to the inserted position of cable P is clamped by the clamping unit 11, and thereafter the vertical hot press unit 16 is stroked vertically and downwardly by the cylinder 18 to move from the position indicated by the solid line to the stroked position indicated by the dot-dash line. Thus, the core wire A is bent down. The support unit 20 is also vertically moved at this time by the cylinder 21 from the initial position indicated by the solid to supporting position indicated by the dot-dash line to contact the cable P. The horizontal hot press unit 17 is horizontally moved by the cylinder 19 from the initial position indicated by the solid line to the extended position indicated by the dot-dash line to bend back the core wire A toward another end of the cable along the insulating member thereof. It is to be noted that the hot presses 16 and 17 are heated by an appropriate heating device such as electric heating wires W1 and W2 incorporated therein.

Figure 8:
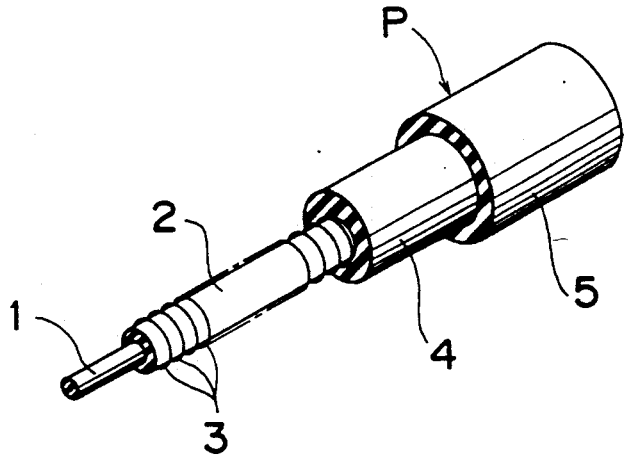
FIG. 8 is a cut-away view of part of a wrapped electric cable.

In operation, the electric cable P as shown in FIG. 8 is stripped of its insulating members to expose the core wire A therein. Stripping operation of the cable P are detailedly described in U.S. patent application Ser. No. 07/799,566 filed Nov. 27, 1991, now patent No. 5,138,910, issued Aug. 18, 1992, assigned to the same assignee as the present application. Then, the stripped cable P is inserted into the inserted position in which the cable P is clamped by the clamping unit 11 as described in the above. Clamping operation of the cable P are also detailedly described in U.S. patent application Ser. No. 07/799,526 filed Nov. 27, 1991 assigned to the same assignee as the present application.

Figure 5:
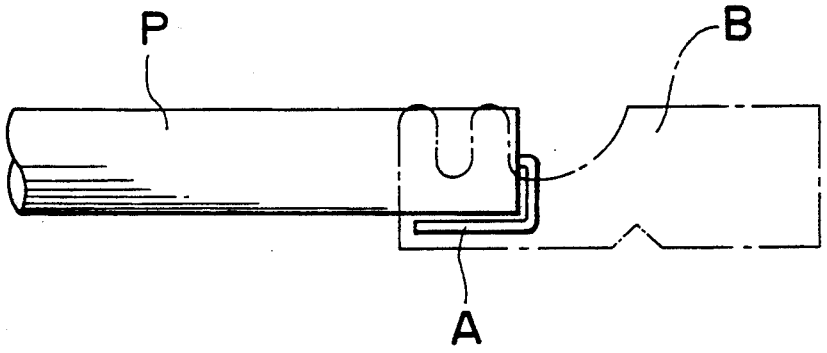
Fig. 5 PRIOR ART
FIGS. 5, 6, and 7 are plan views for illustrating the states in which the electric lug is crimped to fix to the electric cable.
Figure 6:
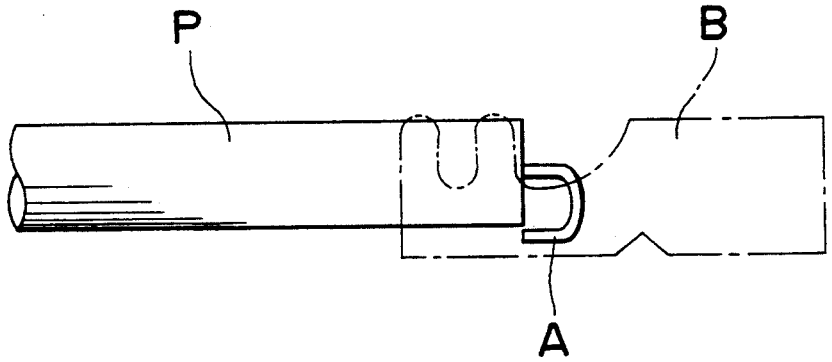
Fig. 6 PRIOR ART
Figure 7:
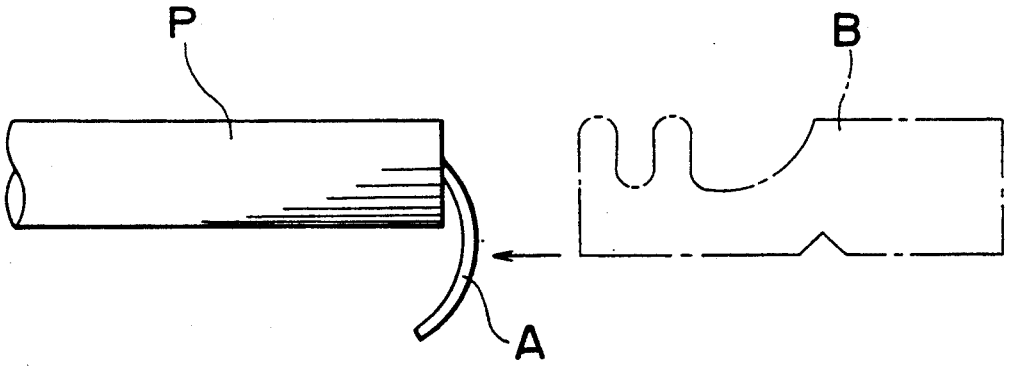
Fig. 7 PRIOR ART

Then, the vertical hot press 16 goes down as shown in FIG. 1, so that the core wire A is bent down by the hot press 16. During the downward stroke of the hot press 16, the core wire A is bent perpendicularly. Then, the support unit 20 goes down and contacts with the cable P at the insulating member thereof. Then, the horizontal hot press 17 strokes forward. The bent core wire A is heated and further bent backward toward the other end of the cable P along with the surface of the insulating members 4 and 5 thereof. Since the support unit 20 supports the cable P against the pushing force generated by the hot press 17 during its movement to the extended position, the stripped portion, which is the core wire A, is permanently bent in U-shape as shown in FIG. 5.

Figure 2:
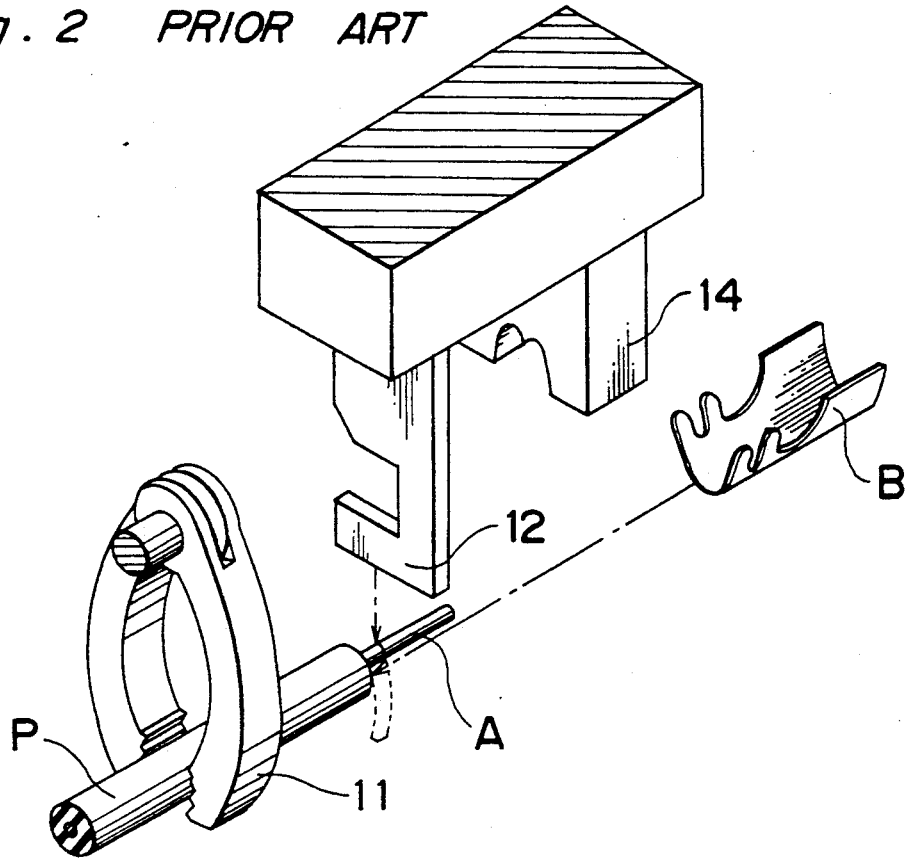
Fig. 2 PRIOR ART
FIGS. 2, 3, and 4 are views for illustrating the bending operation of the electric cable in the conventional art.
Figure 3:
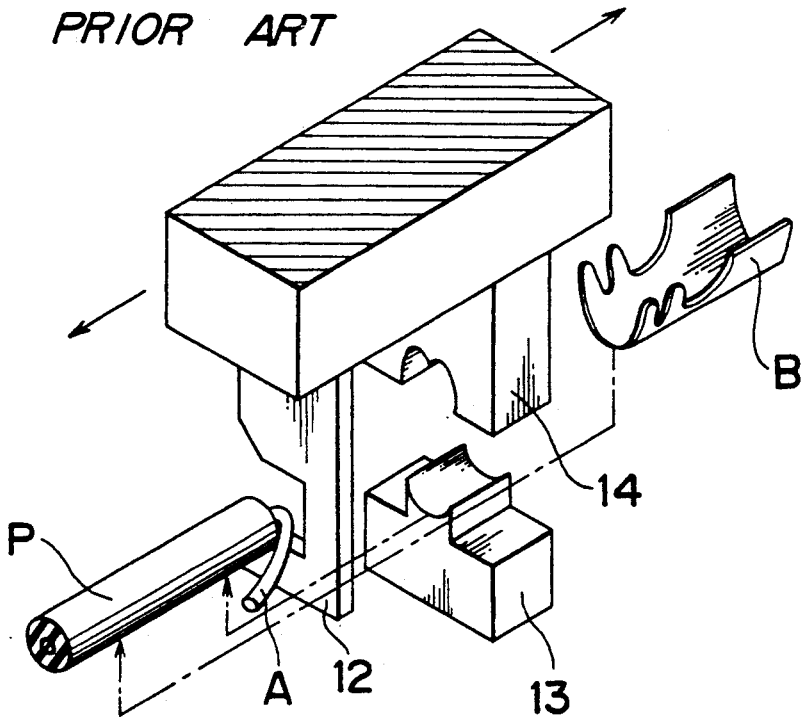
Fig. 3 PRIOR ART
Figure 4:
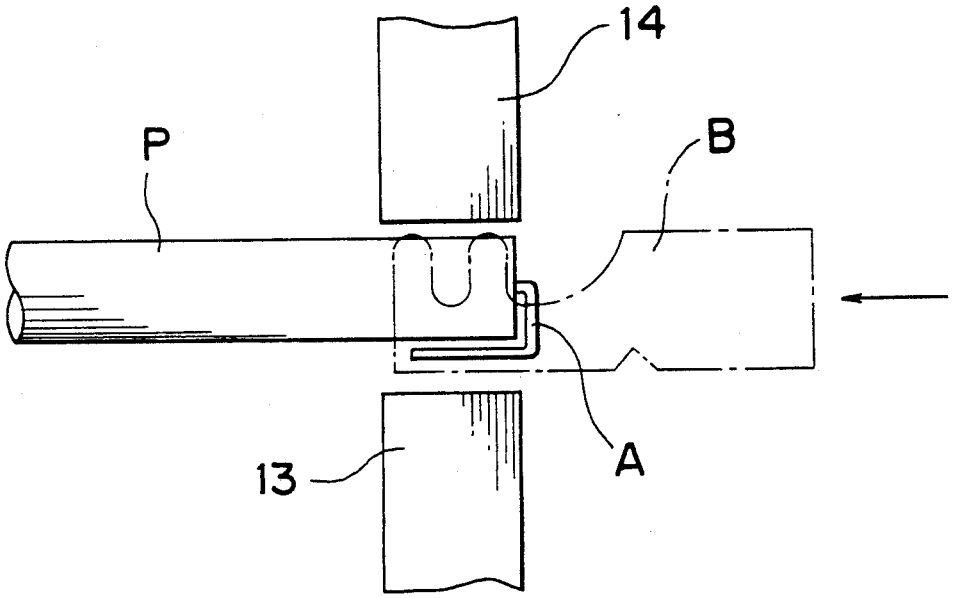
Fig. 4 PRIOR ART

After bending of the core wire A by the bending device BD, the cable P is provided with a terminal lug B in the same manner as that described above in connection with FIGS. 2, 3, and 4.

By fixing the terminal lug B to the cable P after bending the core wire A in the manner described above, the permanently bent core wire A will not return to the straight condition. Thus, there will be no damage of the core wire A by the edge of terminal lug B. Also, the electrical connection between the core wire A and the terminal lug B can be accomplished firmly with a high reliability.

It is preferable to employ an automatic control system to execute the operation of inserting the cable P into the inserted position, clamping the cable P by the clamping unit 11 driven by the motor 15, moving of the hot press 16 and 17 by the cylinders 18 and 19, and stroking the support unit 20 by the cylinder 21. However, these operations can be carried out manually.

Although the above embodiment is described to apply a terminal lug B to an electric cable, such as shown in FIG. 8, it will be obvious that any other type of cable, such as a cable comprised of thermoplastic material with a conductor 3 therein formed of fabric or net, can be used.

It is also possible to provide the anvil 13 and crimper 14 used in the prior art on the frame F of the bending device BD according to the present invention for executing the continuous operation for fixing the terminal lug to the cable end after bending operation.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims.

What is claimed is:

1. A method for bending an exposed core wire (A) of an electric cable (P) having an insulating member thereon, said method comprising the steps of:

clamping said electric cable (P) at a clamping position adjacent said exposed core wire (A) so that an axis of said electric cable extends in a first direction;

bending said exposed core wire (A) with a first die, at an angle substantially perpendicular to said axis of said electric cable (P) while simultaneously heating said exposed core wire with a first heater integrally incorporated in said first die, said first die being moved in a direction substantially perpendicular to said axis; and bending said perpendicularly bent core wire (A) with a second die, at an angle substantially parallel to said axis of said electric cable (P) so that an end portion of said core wire extends along the surface of said insulating member (4 and 5) while simultaneously heating said exposed core with a second heater integrally incorporated in said second die, said second die being moved relative to said first die and in a direction substantially parallel to said axis.

2. A bending method as claimed in claim 1 further comprising the step of supporting said electric cable against a pushing force applied in a direction perpendicular thereto during said horizontally bending step.

3. An electric cable bending device (BD) for bending an exposed portion of a core wire (A) of an electric cable (P) having a coating member thereon, said device comprising:

a frame structure (F);

clamping means (11 and 15) provided on said frame structure (F) for clamping said electric cable (P) at a clamping position adjacent said exposed core wire (A) so that an axis of said electric cable extends in a first direction; and a first die having first heating means (W1) integrally incorporated therein, said first die being provided on said frame structure (F) for heating and bending said exposed core wire (A) substantially perpendicular to said axis of said electric cable (P) when said first die moves from a first position to a second position thereof in a direction perpendicular to said axis;

second die having second heating means (W2) integrally incorporated therein, said second die being provided on said frame structure (F) for heating and bending said core wire (A) substantially parallel to said axis of said electric cable (P), so that an end portion of said core wire extends along the surface of coating member (4 and 5), when said second die moves from a third position to a fourth position thereof in a direction parallel to said axis, said first and second dies being movable relative to one another.

4. An electric cable bending device as claimed in claim 3, further comprising: a supporting means provided on said frame structure for supporting said electric cable at a position adjacent to said exposed portion of core wire against a pushing force generated by said second die during horizontal reciprocating movement thereof.

* * * * *